United States Patent [19]

Sekine et al.

[11] Patent Number: 5,052,124

[45] Date of Patent: Oct. 1, 1991

[54] METHOD FOR TRANSPORTING HOT-ROLLED WIRE ROD AND APPARATUS THEREFOR

[75] Inventors: Susumu Sekine; Katsumi Ito; Noriyoshi Ohwada; Toyoaki Eguchi, all of Tokyo, Japan

[73] Assignee: Toa Steel Co., Ltd., Tokyo, Japan

[21] Appl. No.: 426,891

[22] Filed: Oct. 23, 1989

[30] Foreign Application Priority Data

Feb. 20, 1989 [JP] Japan ..... 1-39653

[51] Int. Cl.[5] ..... F26B 7/00; C21D 1/62

[52] U.S. Cl. ..... 34/20; 62/64; 134/14; 148/125; 266/259

[58] Field of Search ..... 34/20, 105; 134/14, 134/131; 62/64, 374; 148/125; 266/114, 259

[56] References Cited

U.S. PATENT DOCUMENTS 3,832,788 9/1974 Kato et al. ..... 34/20

4,168,993 9/1979 Wilson et al. ..... 266/259

*Primary Examiner*—William E. Wayner

*Attorney, Agent, or Firm*—Frishauf, Holtz, Goodman & Woodward

[57] ABSTRACT

A method for transporting a hot-rolled wire rod comprises changing directions of movements of the wire rod to the left and to the right relative to the center line of a conveyer at an interval of d/3 to 2d of a diameter of a ring of the wire rod and shifting the center of the ring of the wire rod from the center line of the conveyer by a length of 2d/100 to 30d/100 at its maximum.

An apparatus for transporting hot-rolled wire rod comprises a conveyer for transporting a hot-rolled wire rod and guide means alternately arranged in an upper portion of the side of the conveyer to change the directions of movements of the wire rod to the left and to the right relative to the center line of the conveyer.

A further apparatus for transporting hot-rolled wire rod comprises side walls arranged in zigzags facing each other on the both sides of the conveyer to have the wire rod move in zigzags with the center line of the conveyer as the center and guide members arranged on the side walls arranged toward the center line of the conveyer.

4 Claims, 8 Drawing Sheets

METHOD FOR TRANSPORTING HOT-ROLLED WIRE ROD AND APPARATUS THEREFOR

BACKGROUND OF THE INVENTION

1. FIELD OF THE INVENTION

The present invention relates to a method for transporting hot-rolled wire rod and an apparatus therefor.

2. Decription of the Related Arts

Among method of direct patenting of high-carbon wire rod, a method of air patenting by the use of air-blast holds the leading position. However, since a cooling capability of the air-blast in the air patenting is low, a high strength and a high ductility cannot be added to wire rod as in a lead patenting carried out in an off-line.

To increase the cooling capability of the air-blast, a mist-cooling method is proposed. A method wherein an air-blast mist produced by mixing water with the air-blast is used, a method wherein mist produced by spraying water is used, and the like are pointed out as the mist cooling method. However, the side edge portions of rings of wire rod, which is transported in a state such that said wire rod is in the form of continuous series of loops, in the direction of the width of a conveyer overlap each other. If the rings of wire rod which overlap each other are not shifted one from another, the wire rod is not uniformly cooled and there occurs a deviation of strength and ductility of the wire rod. In consequence, the wire rod which can be put to practical use cannot be manufactured.

A method, wherein conveyer rollers are arranged at a certain interval, diameters of both ends of one end of the roller at every several rollers are made large and wire rod is cooled by moving up-and-down the side edge portions of wire rod, is disclosed in a Japanese Utility Model Application Laid Open No. 58839/74. A method, wherein the side edge portions of wire rod are moved up-and-down by means of an eccentric roller, also is disclosed in a Japanese Utility Model Application Laid Open No. 58838/74. Those methods are, however, substantially not effective in mist cooling of the wire rod when time of separation of the rings of wire rod one from another is short and a cooling rate is from 15° to 30° C.

An air patenting method as shown in FIG. 10 is disclosed in a Japanese Patent Application Laid Open No. 15609/74. In this method, vertical rollers 12 are alternately arranged at a predetermined interval on side walls 11 of conveyer 10. Wire rod 13 is moved in zigzags by the vertical rollers 12. The wire rod 13 is cooled by air during its movement.

The method disclosed in the Japanese Patent Application Laid Open No. 15609/74 has, however, the following problems:

(a) When the wire rod 13 is about to be cooled uniformly by making large a shift of the center of a ring of the wire rod 13 from a center line of a conveyer 10, resistance of the wire rod 13 during its transportation grows large in a position of vertical roller 12 which pushes in the wire rod 13 toward the center line of the conveyer.In consequence, since a ring pitch of the wire rod 13 in a push-in position of the wire rod 13 becomes small, a rate of cooling of the wire rod 13 decreases. Hereinafter, the shift of the center of wire rod 13 from the center line of the conveyer is referred to as an amount of zigzag movement. Accordingly, the amount of zigzag movement of the wire rod 13 cannot be increased.

(b) Since intervals among the vertical rollers 12 are made small, the resistance, with which the wire rod 13 meets, grows large and the ring pitches of the wire rod grow smaller. The rate of cooling of the wire rod 13 decreases at a rate of decrease of ring pitches. Therefore, the intervals among the vertical rollers 12 have to made large to some extent. Since the rate of cooling of the wire rod 13 is small in the case of the air patenting and a length of a cooling zone can be made large, an object of cooling of the wire rod 13 can be accomplished even though intervals among the vertical rollers 12 are large. However, when the rate of cooling of the wire rod 13 is large as in the mist cooling, only several vertical rollers 12 are arranged since the cooling zone has a small length of about 10 m. Accordingly, the number of the zigzag movements of the wire rod 13 are approximately twice or three times.

(c) Although the center of the wire rod 13 is shifted from the center line of the conveyer by means of the vertical rollers 12, the rings of the wire rod 13 are transported in a state of being overlapped and there is no portion where the wings of the wire rod 13 are shifted one from another. Accordingly, nonuniformity of cooling of the wire rod is produced.

(d) The ends of the wire rod 13 have not ring shape, but irregular shapes. Therefore, when the vertical rollers 12 are used being exposed, the end portion of the wire rod is caught by the vertical rollers 12. In consequence, the wire rod 13 cannot often be transported smoothly.

SUMMARY OF THE INVENTION

It is an object of the present invention to provide a method for transporting hot-rolling wire rod and an apparatus therefor which can cool the hot-rolled wire rod easily, surely and uniformly.

To accomplish the above-mentioned object, the present invention provides a method for transporting hot-rolled wire rod, comprising:

transporting a hot-rolled wire rod on a conveyer in a state such that said wire rod is in the form of continuous series of loops, said wire rod being cooled;

changing directions of movements of said wire rod alternately to the left and to the right relative to a center line of a conveyer at an interval of d/3 to 2d of a diameter "d" of a ring of said wire rod; and shifting the center of the ring of said wire rod from the center line of the conveyer by a length of 2d/100 to 30d/100 at its maximum.

The present invention also provides an appratus for transporting hot-rolled wire rod comprising:

a conveyer for transporting a hot-rolled wire rod in a state such that said wire rod is in the form of continuous series of loops; and guide means alternately arranged in an upper portion of the side of said conveyer for changing directions of movements of said wire rod alternately to the left and to the right relative to a center line of a conveyer.

Further, the present invention provides an apparatus for transporting hot-rolled wire rod comprising:

a conveyer for transporting a wire rod in a state such that said wire rod is in the form of continuous series of loops;

side walls arranged in zigzags facing each other on both sides of the conveyer to have said wire rod move in zigzags with the center line of the conveyer as the center, said side walls including a side wall arranged toward the center line of the conveyer relative to the direction of movement of said wire rod and a side wall arranged away from the center line of the conveyer; and a guide member arranged on the side walls arranged toward the center line of the conveyer.

The above objects and other objects and advantages of the present invention will become apparent from the detailed description which follows, taken in conjunction with the appended drawings.

BRIEF DESCRIPTION OF THE DRAWINGS

FIG. 1 (B) is a top plan view illustrating a movement of portions of the wire rod, where the rings of the wire rod overlap each other, in the case of moving the wire rod in zigzags;

FIG. 3 (B) is a sectional view of the apparatus taken on line 1—1 of FIG. 3 (A) of the present invention;

FIG. 3 (C) is a sectional view of the apparatus taken on line 2—2 of FIG. 3 of the present invention;

FIG. 4 (B) is a sectional view of the apparatus taken on line 3—3 of FIG. 4 (A) of the present invention;

FIG. 4 (C) is a sectional view of the apparatus taken on line 4—4 of FIG. 4 (A) of the present invention;

DESCRIPTION OF THE PREFERRED EMBODIMENT

Figure 1:
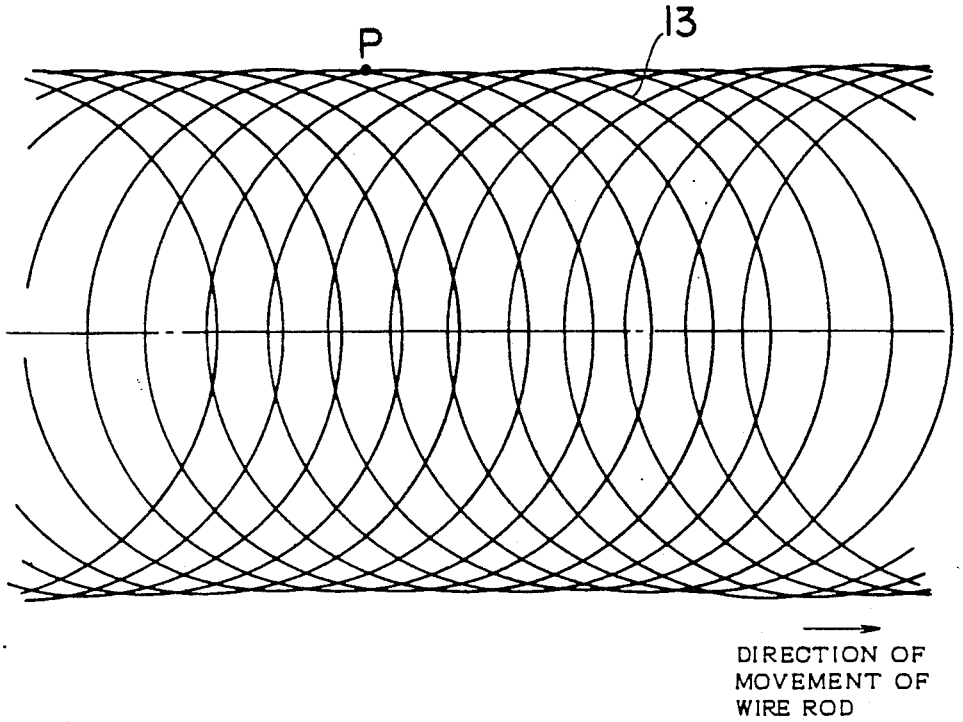
FIG. 1 (A) is a top plan view illustrating a movement of portions of wire rod, where rings of the wire rod overlap each other, in the case of not moving the wire rod in zigzags in the prior art method.
Figure 1:
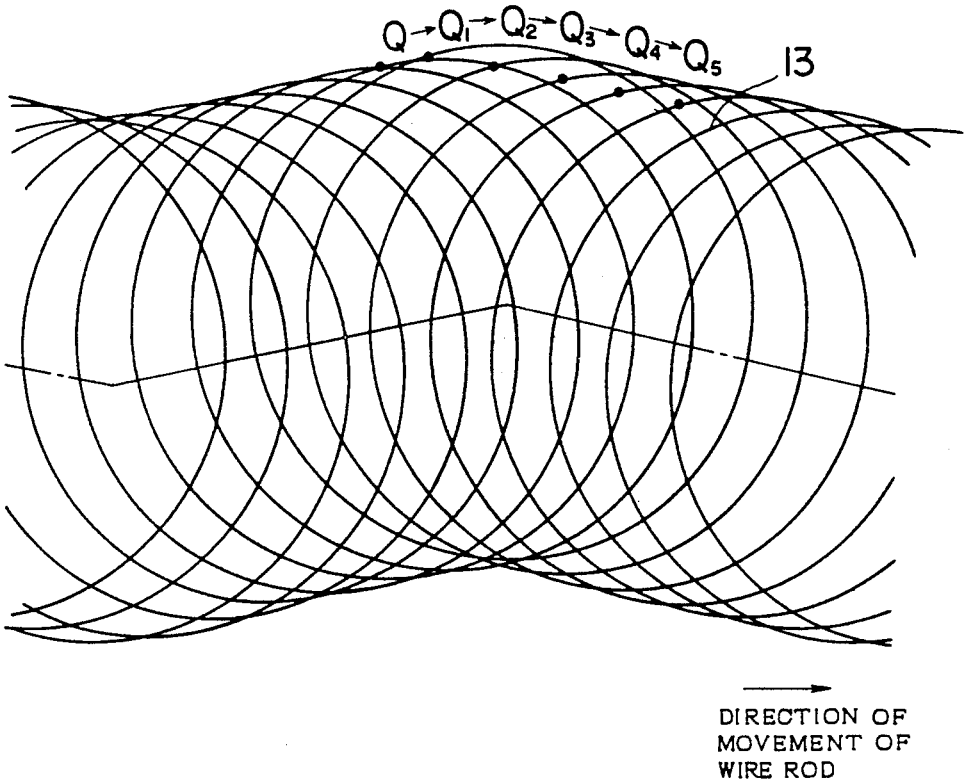

FIG. 1 (A) is a top plan view illustrating a state of portions of wire rod 13, where rings of the wire rod 13 overlap each other, in the case of not moving the wire rod in zigzags. The rings of the wire rod overlap each other in multiple layers in the side edge portion of the conveyer. Although a portion of the wire rod where the rings of the wire rod 13 overlap each other is forcedly cooled from above and below, the overlapped portion of the wire rod is more slowly cooled than the other portions of the wire rod since the overlapped portion of the wire rod does not change. Accordingly, the whole wire rod 13 cannot be cooled uniformly.

Conversely, when the wire rod 13 is moved in zigzags according to the method of the present invention as shown in FIG. 1 (B), point "Q", where the rings of the wire rod overlap each other, moves to $Q_1$, $Q_2$, $Q_3$, $Q_4$, $Q_5$. . . , constantly changing its positions relative to positions of the wire rod 13. Accordingly, the wire rod can be uniformly cooled by the use of this method.

The reason for the limitation of values in the present invention will be described.

Directions of movements of the wire rod are desired to be alternately changed to the left and to the right relative to the center line of the conveyer at an interval of d/3 to 2d of a diameter of the wire rod. When the interval is less than d/3, the directions of movements of the wire rod have to be changed at a wide angle to obtain a desired amount of zigzag movement of the wire rod. Since the directions of movements of the wire rod are changed at a wide angle, resistance, with which the wire rod meets, grows large. When the interval exceeds 2d, the number of the zigzag movements decrease. In consequence, the wire rod cannot be uniformly cooled. Diameters of the rings of hot-rolled wire rod are usually within a range of 900 to 1300 mm.

The maximum shift of the center of the ring of the wire rod from the center line of the conveyer, namely, the push-in length of the wire rod is desired to be 2d/100 to 30d/100. When the push-in length of the wire rod is less than 2d/100, the rings which overlap each other cannot be shifted one from another. Therefore, the wire rod cannot be uniformly cooled. When the push-in length of the wire rod exceeds 30d/100, the resistance, with which the wire rod meets during its transportation, increases and a width of the conveyer is required to be made large. Therefore, such push-in length is not favorable from a viewpoint of equipment.

When the push-in length of the wire is 2d/100 or more and less than 8d/100, the wire rod can be uniformly cooled though the push-in length of the wire rod is small. When the push-in length of the wire rod is more than 24d/100 and 30d/100 or less, the push-in length of the wire rod grows large, but the wire rod can be uniformly cooled. The push-in length of the wire rod of 8d/100 or more and 24d/100 or less is most desirable.

Subsequently, an apparatus transporting hot-rolled wire rod of the present invention will be described with specific reference to the appended drawings.

Figure 2:
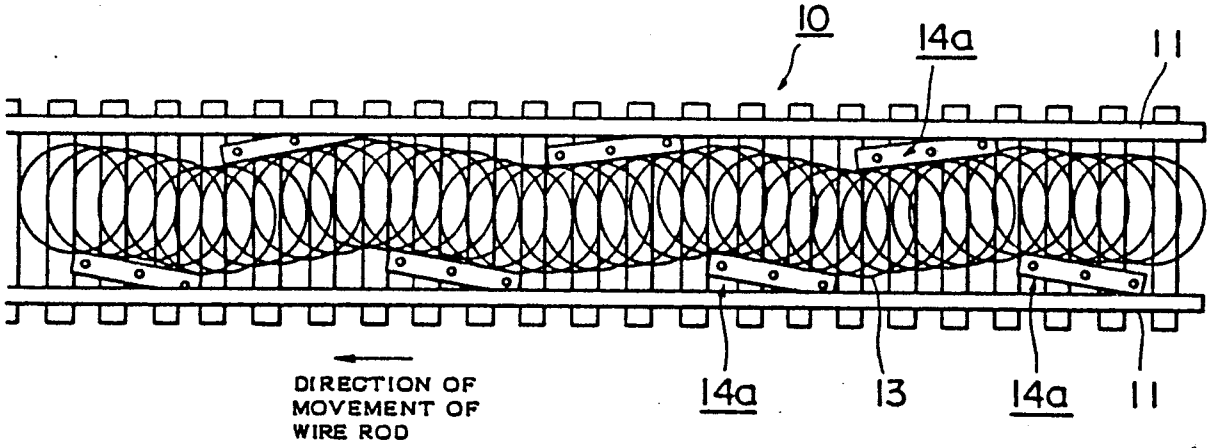
FIG. 2 is a top plan view illustrating an apparatus for transporting hot-rolled wire rod of the present invention.
Figure 10:
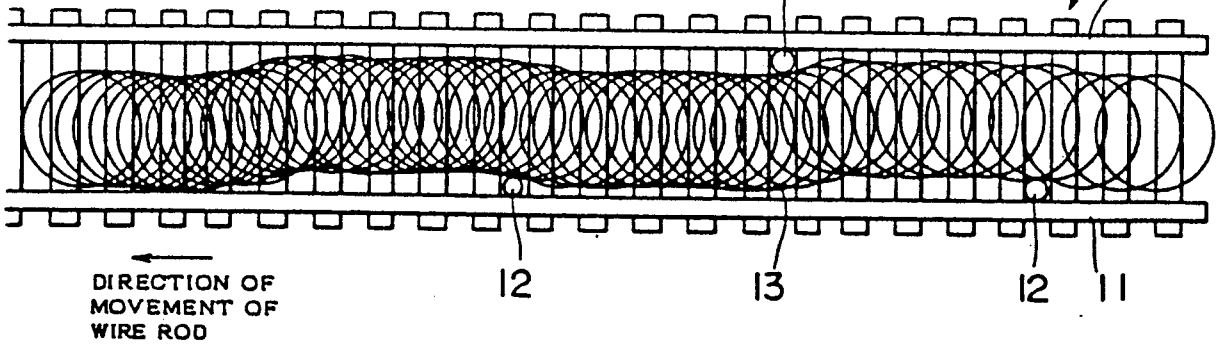
Fig. 10 (PRIOR ART)
FIG. 10 is a top plan view illustrating the prior art apparatus for transporting hot-rolled wire rod.
Figure 3A:
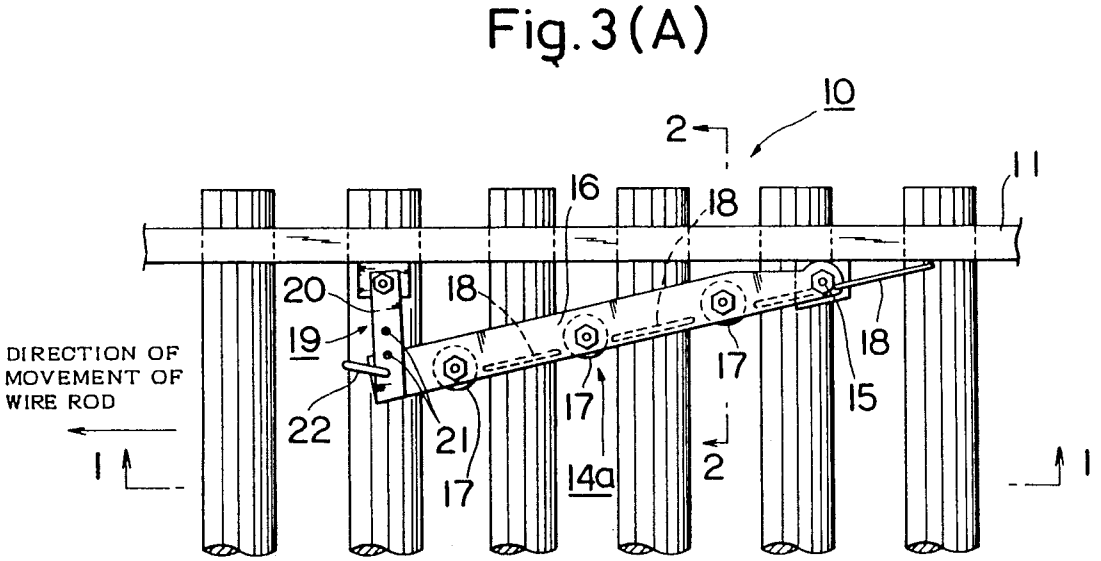
FIG. 3 (A) is a partial top plan view designating the apparatus of FIG. 2 of the present invention.
Figure 3B:
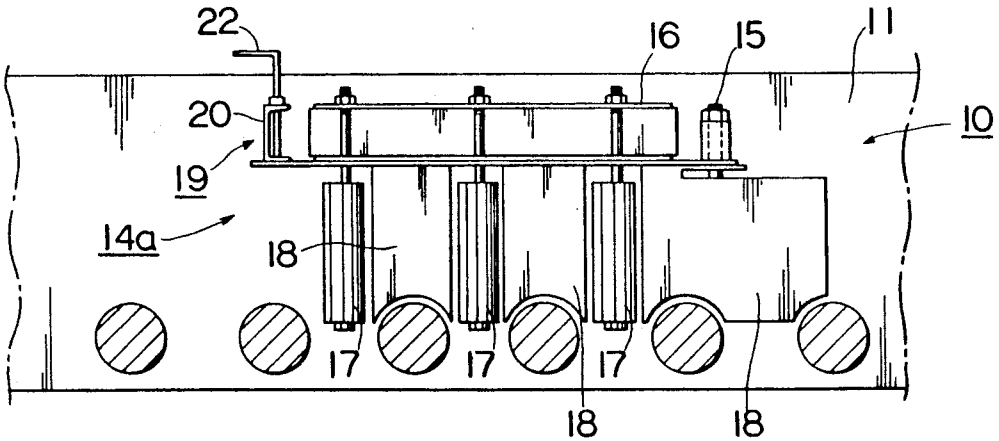
Figure 3C:
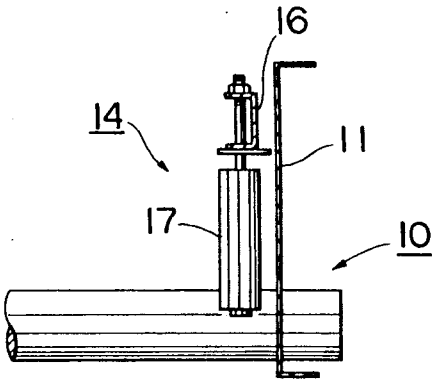
Figure 4A:
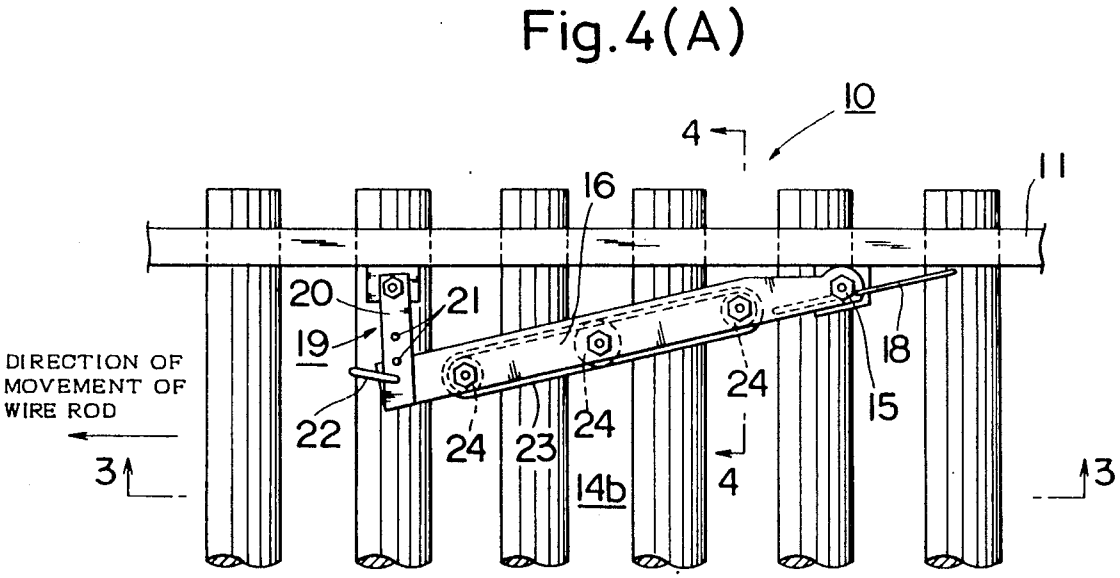
FIG. 4 (A) is a top plan view showing a further apparatus for transporting hot-rolled wire rod of the present invention.
Figure 4B:
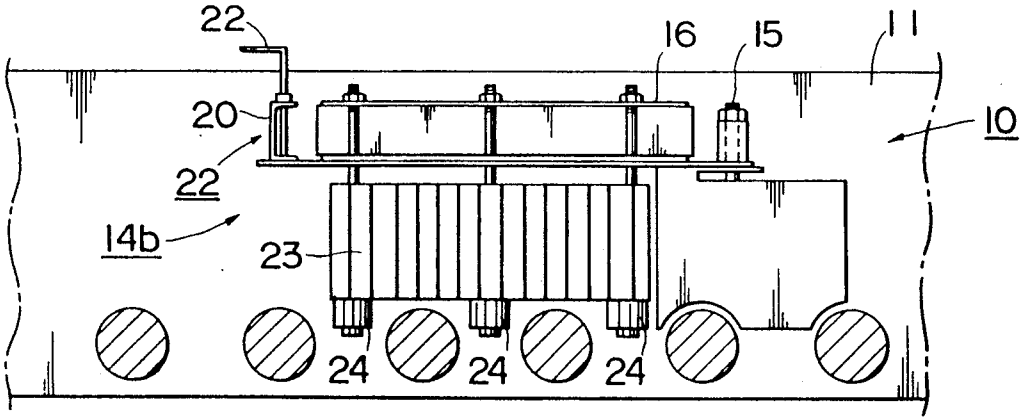
Figure 4C:
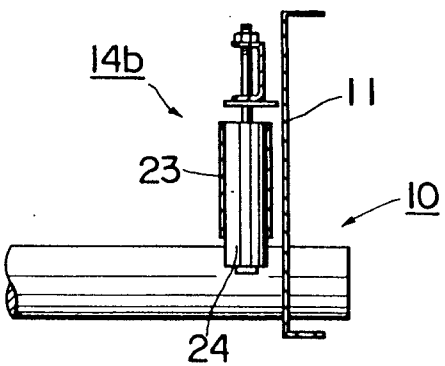

FIG. 2 is a top plan view illustrating the apparatus for transporting hot-rolled wire rod of the present invention. FIG. 3 (A) is a partial top plan view illustrating the apparatus of FIG. 2 of the present invention. FIG. 3 (B) is a sectional view of the apparatus taken on line 1—1 of FIG. 3 (A) of the present invention. FIG. 3 (C) is a sectional view of the apparatus taken on line 2—2 of FIG. 3 (A) of the present invention.

Guide means 14*a* for changing alternately directions of movements of a wire rod 13 in a state such that said wire rod is in the form of continuous series of loops to the left and to the right relative to the center line of a conveyer, that is, for moving the wire rod 13 in zigzags are alternately arranged on side walls 11 of conveyer 10 for transporting the wire rod. Positions, on which the guide means 14 are mounted, are not confined to the side walls 11 of the conveyer. The guide means can be mounted near the conveyer 10. Each of the guide means 14 comprises arm 16 for changing the directions of movements of the wire rod 13 toward the center line of the conveyer 10 and a plurality of vertical rollers 17 vertically arranged at a definite interval along the longitudinal direction of the arm 16. The end of the arm 16 is axially fixed on the side wall 11 of the conveyer 10 by means of axis 15 on the upstream in the direction of the movement of the wire rod. Blocking plates 18 are vertically fixed in a lower portion of the arm 16 to block up openings among rollers 17. The end of the arm 16 is fixed with stopper 19 on the downstream in the direction of the movement of the wire rod. Instead of the blocking plates 18, a plurality of other rollers of smaller diameter than that of the vertical roller 17 can be arranged among the vertical rollers 17.

Said stopper 19 comprises connecting member 20, whose end is axially connected to the side wall 11 of the conveyer 10, pin hole 21 formed at the end of the connecting material 20 and the arm 16 on the downstream in the direction of movement of the wire rod and pin 22 to be inseted into said pin hole 21. An angle formed by the arm 16 relative to the center line of the conveyer can be changed in accordance with diameters of the rings of the wire rod 13. Instead of the stopper 19, the end of a motor-driven cylinder can be axially fixed at the end of the arm 16 on the downstream in the direction of movement of the wire rod.

With the use of the apparatus tor transporting hot-rolled wire rod in zigzags which is constituted in such a manner as described above, the wire rod 13 is transported in the following way:

Arm 16 is arranged toward the center line of the conveyer in accordance with a diameter of the wire rod 13 with axis 15 as the center. Then, the arm 16 is fixed in a predetermined position by means of pin 22 of stopper 19. The wire rod 13 moving on the conveyer 10 is smoothly and continuously pushed in toward the center line of the conveyer 10 by means of the vertical rollers 17. Since the wire rod is transported on the conveyer 10, moving in a continuous zigzag in this way, the portions of the wire rod 13 where the rings of the wire rod overlap each other change constantly. Accordingly, the wire rod 13 is uniformly cooled. Further, since openings among the vertical rollers 17 are blocked up with the blocking plates 18, the end of the wire rod 13 cannot be caught by the openings among the vertical rollers 17.

A further quide means **14*b* is shown in FIGS. (A) to (C). The quide means 14*b* comprises arm 16 arranged toward the center line of the conveyer 10 in the upper portion of the conveyer 10 and rotating belt 23 mounted in the lower portion of said arm 16 along said arm 16. The rotating belt 23 is mounted endlessly among pulleys 24 vertically mounted on the arm 16. A chain can be used instead of the rotating belt 23. The quide means has member 19 connecting the arm 16 to the side wall of the conveyer 10, pin holes 21 made in the member 19 to change angles of the guide means relative to the direction along the center line of the conveyer and pin 22** to be inserted into the pin holes made at the end of the arm.

Figure 5:
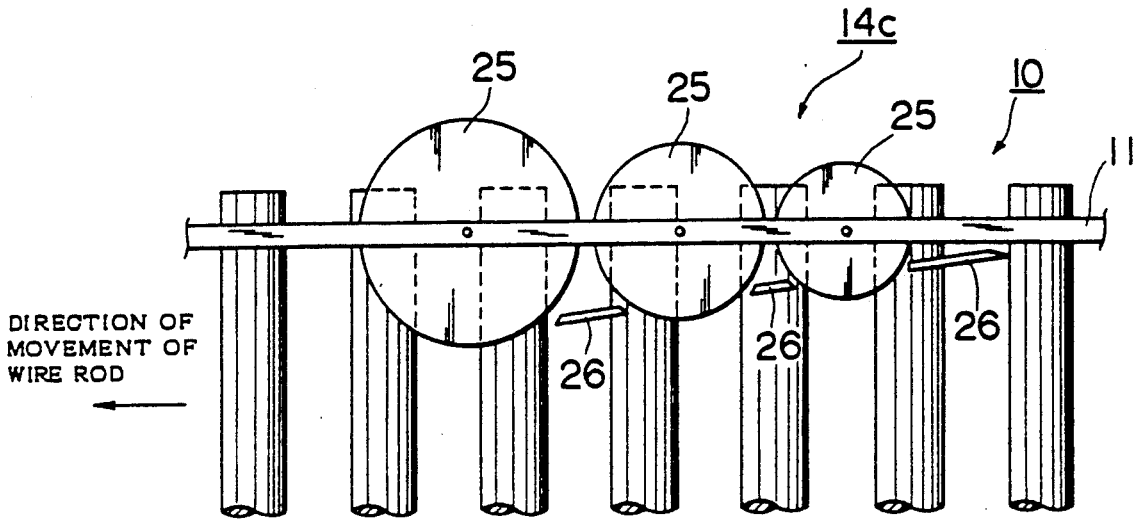
FIG. 5 is a top plan view illustrating a still further apparatus for transporting hot-rolled wire rod of the present invention.

A still further guide means **14*c* is shown in FIG. 5. The guide means 14*c* comprises a plurality of vertical rollers 25 of different diameters vertically arranged in the upper portion of the side of the conveyer 10 at a definite interval along said conveyer. The diameter of said vertical roller grows large as the wire rod goes downstream in the direction of movement of the wire rod. There are blocking plates 26** arranged among said vertical rollers to block up the openings formed among the vertical rollers.

Figure 6:
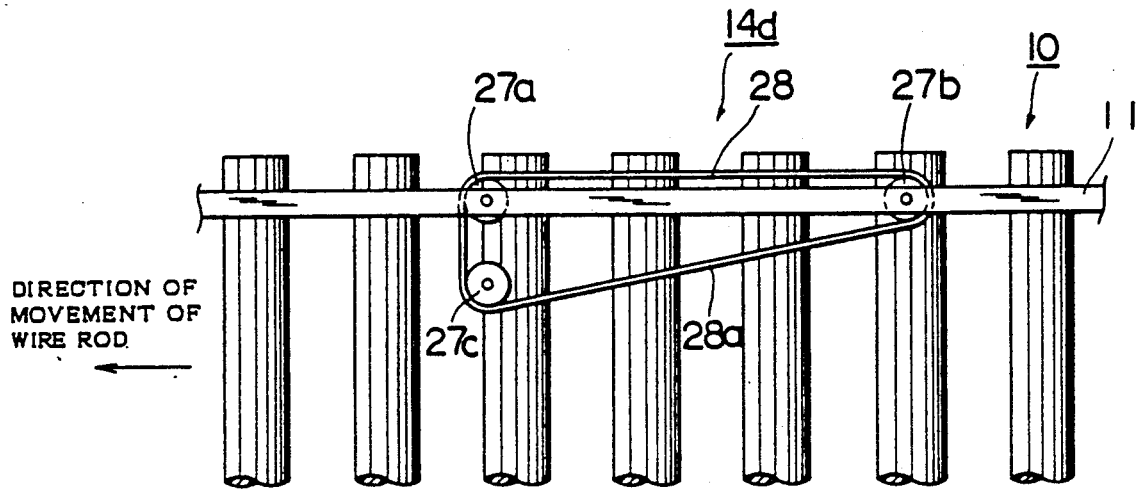
FIG. 6 is another apparatus for transporting hot-rolled wire rod of the present invention.

Further, another guide means **14*d* is shown in FIG. 6. The guide means 14*d* comprises two pieces of first pulleys 27*a* and 27*b* vertically arranged in the upper portion of the side of said conveyer at a definite interval along said conveyer, second pulley 27*c* arranged, being shifted from the side of the conveyer toward the center line of the conveyer, and rotating belt 28 endlessly arranged between the first pulley and the second pulley. The side of feed belt 28*a* of the rotating belt 28 comes near the center line of the conveyer 10** as the wire rod goes downstream in the direction of movement of the wire rod.

Figure 7:
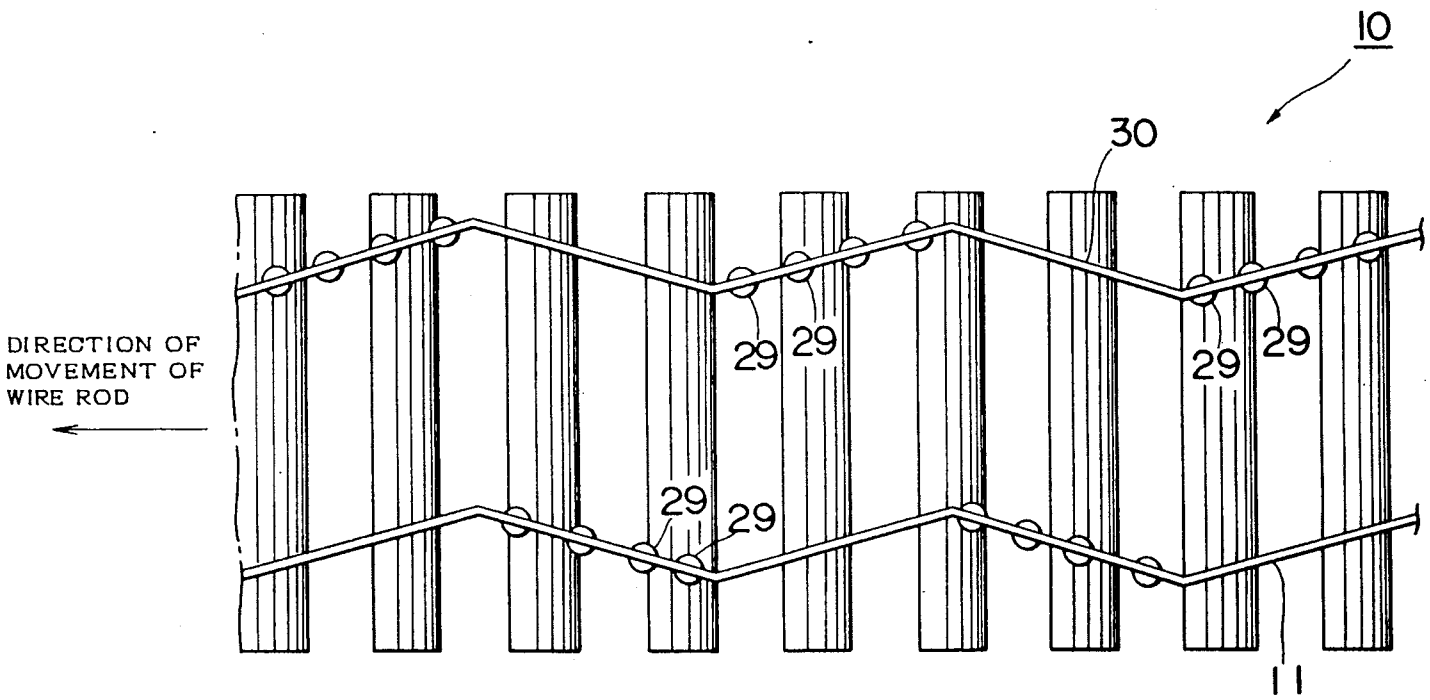
FIG. 7 is a further apparatus for transporting hot-rolled wire rod of the present invention.

FIG. 7 shows a further apparatus for transporting hot-rolled wire rod of the present invention. This apparatus comprises conveyer 10 for transporting a hot-rolled wire rod in a state such that said wire rod is in the form of continuous series of loops, side walls 30 arranged in zigzags, facing each other, to have the wire rod move in zigzags with the center line of said conveyer as the center and guide members 29 arranged on the side walls 30 arranged toward the center line of the conveyer 10. Said side wall 30 comprises side walls arranged toward the center line of the conveyer 10 and in the direction of movement of the wire rod and side walls arranged away from the center line of the conveyer. The vertical rollers or the rotating belt are used as the guide members 29. As far as rotating resistance of the wire rod does not grow extremely large, the vertical rollers or the rotating belt which are rotated by a transporting force of the wire rod can be used. The vertical rollers or the rotating belt can be rotated by the use of an electrical motor. The wire rod can be uniformly cooled by spirally forming grooves on the vertical rollers or the rotating belt, then putting the wire rod into the grooves and suspending the wire rod. Further, when the side walls of the conveyer, on which the guide means are mounted, are made movable in the direction of the width of the conveyer by means of cylinder or the like, the guide means can be easily inspected and maintained.

Subsequently, mechanical properties of piano wire (SWRH 82B) having a composition as shown in Table 1, which were made clear when the piano wire was cooled during transportation of the wire rod by means of an apparatus for transporting hot-rolled wire rod in zigzags as shown in FIG. 2 and FIGS. 3 (A) to (B), are shown together with test conditions in Table 2.

Air-blast and mist were used as cooling medium. A rate of the air-blast was 20 m/min. A mixture of water and air produced by mixing water with air by the use of sprays at a rate of 30 $m^3$/hr for wire rod of 5.5 mm in diameter and at a rate of 60 $m^3$/hr for wire rod of 11 mm in diameter was used. A ring diameter of the wire rod was 1050 mm. Tensile stregth test was conducted on 4 rings of the wire rod, each of which was divided into 12 equal parts.

In Table 2, Nos. 1 and 5 designate wire rod having been subjected to ordinary air-blast cooling without zigzag movement of the wire rod. Nos. 3 and 7 designate wire rod having been subjected to mist cooling without zigzag movement of the wire rod. Nos. 2, 4, 6 and 8 show wire rod having been cooled by the use of the method of the present invention.

TABLE 1

| Steel | C | Si | Mn | P | S |
|---|---|---|---|---|---|
| SWRH 82B | 0.83 | 0.21 | 0.79 | 0.014 | 0.010 |

TABLE 2

| Nos. | Size mmϕ | Start Temp. of Rapid Cooling °C. | Cooling Medium | Cooling Rate °C./sec | Push-in Length of Zigzag mm | Tensile Strength (kg f/mm²) Aver. | Max. | Min. | Max.-Min. | σ | Drawability (%) Aver. | Max. | Min. | Max.-Min. | σ |
|---|---|---|---|---|---|---|---|---|---|---|---|---|---|---|---|
| 1 | 5.5 | 820 | Air-Blast | 12 | 0 | 114.8 | 117.0 | 110.1 | 6.9 | 1.21 | 45.2 | 47.9 | 41.1 | 6.8 | 1.55 |
| 2 | | 820 | Air-Blast | 12 | 60 | 115.6 | 117.0 | 113.6 | 3.4 | 0.71 | 45.6 | 48.7 | 44.4 | 4.3 | 0.97 |
| 3 | | 820 | Mist | 21 | 0 | 125.8 | 129.0 | 117.6 | 11.4 | 2.24 | 49.7 | 51.9 | 42.0 | 9.9 | 1.86 |
| 4 | | 820 | Mist | 21 | 60 | 126.7 | 128.8 | 123.6 | 5.2 | 1.09 | 50.1 | 52.5 | 47.9 | 4.6 | 1.21 |
| 5 | 11 | 820 | Air-Blast | 7 | 0 | 110.5 | 112.3 | 108.2 | 4.1 | 1.20 | 37.3 | 39.9 | 34.5 | 5.4 | 1.32 |
| 6 | | 820 | Air-Blast | 7 | 60 | 110.2 | 111.2 | 108.8 | 2.4 | 0.62 | 38.1 | 40.2 | 36.6 | 3.6 | 0.87 |
| 7 | | 820 | Mist | 19 | 0 | 125.2 | 129.1 | 114.5 | 14.6 | 2.68 | 46.6 | 49.4 | 39.2 | 10.2 | 1.78 |
| 8 | | 820 | Mist | 19 | 60 | 125.6 | 128.8 | 123.5 | 5.3 | 1.17 | 47.0 | 49.5 | 45.3 | 4.2 | 0.95 |

As clearly seen from Table 2, deviation (R) of tensile strength and drawability of the wire rod cooled by the use of the method of the present invention decreases to half of that of tensile strength and drawability of the wire rod cooled without moving in zigzags. Moreover, it is understood that standard deviation (σ) of the tensile strength and drawability of the wire rod is small and the wire rod is uniformly cooled.

Figure 8A:
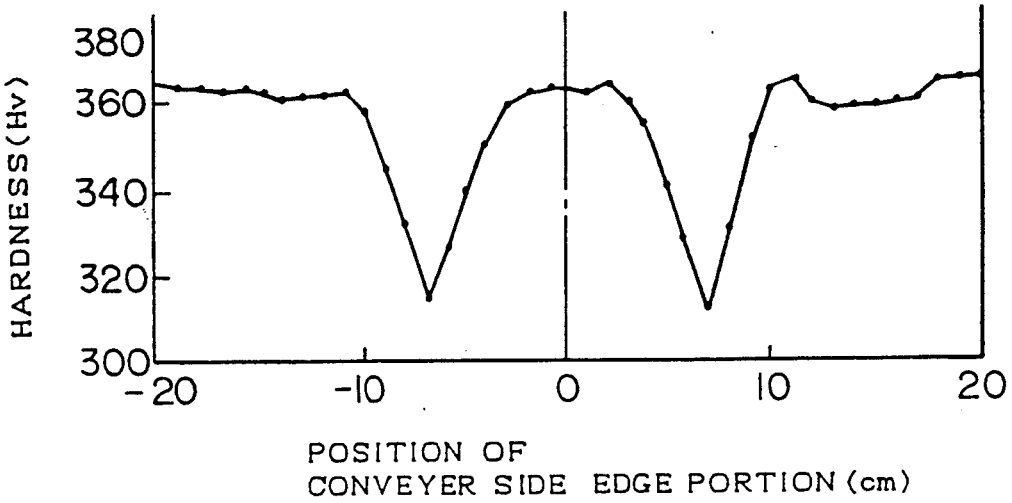
FIGS. 8 (A) and 8 (B) are graphical representations indicating the distribution hardnesses of the wire rod in the side edge portion of a conveyer of the present invention.
Figure 8B:
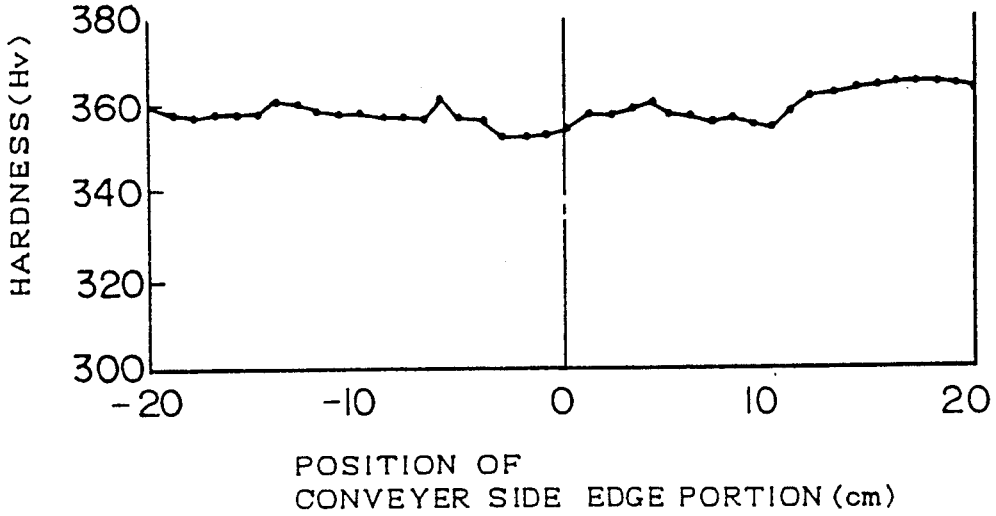

In FIGS. 8(A) and 8(B) there are shown distributions of hardnesses of a wire rod of 12 mm in diameter having a composition as shown in Table 1 at the end of the conveyer when the wire 2od was cooled at a rate of 20° C./sec. FIG. 8(A) shows a case when the wire rod was not moved in zigzags and FIG. 8 (B) a case when the wire rod was moved in zigzags according to the present invention. As clearly seen from FIG. 8(B), any deviation of the hardnesses of the wire rod are not seen and it is understood that the wire rod was uniformly cooled.

Figure 9:
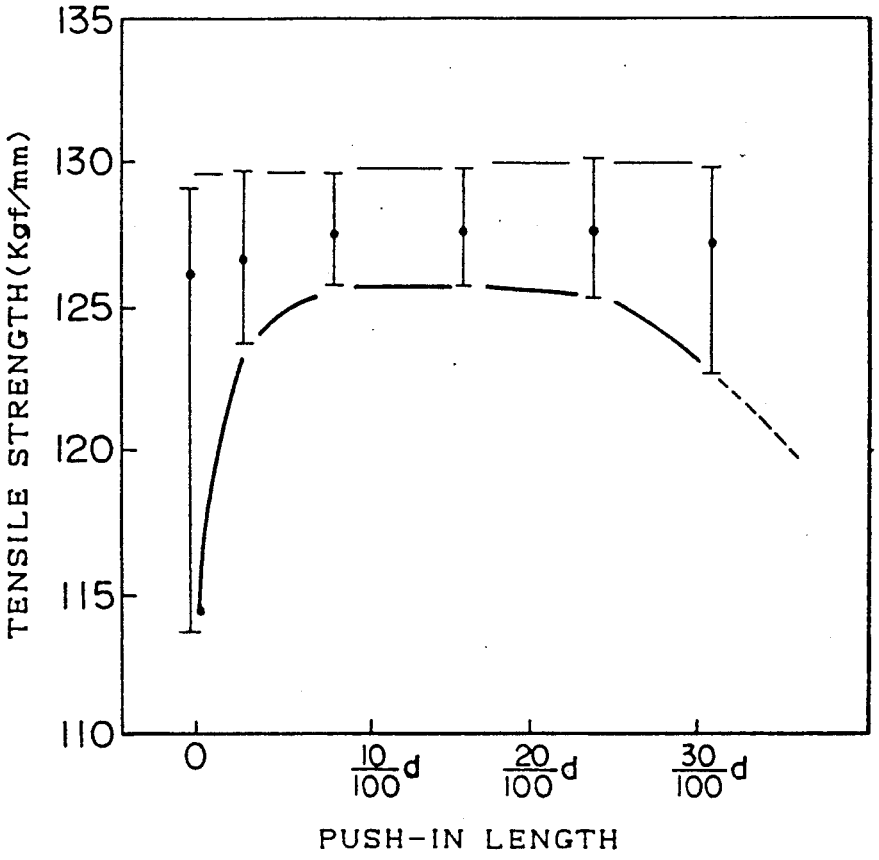
FIG. 9 is a graphical representation indicating the relation between a push-in and tensile strength of the wire rod of the present invention.

In FIG. 9, the relation between push-in length and tensile strength of the wire rod of 9 mm in diameter having a composition as shown in Table 1 is shown. As clearly seen from FIG. 9, in the case the wire rod was not moved in zigzags, that is, the push-in length of the wire rod was zero, deviation of 16 kgf/mm² in the tensile strength occured while deviation of the tensile strengths decreased to approximately 7 kgf/mm² when the wire rod was pushed in by 3 d/100 (about 32 mm) and moved in zigzags. An optimum push-in length of the wire rod is 80 mm. Even though the wire rod is pushed in by 30 d/100, there is no change in effectiveness of cooling of the wire rod. However, when the push-in length of the wire rod exceeds 30 d/100, it is expected that the deviation of tensile strength increases because ring pitches of the wire rod become small due to an increase of resistance of the wire rod in transportation.

What is claimed is:

1. A method for transporting hot-rolled wire rod, comprising:

transporting a hot-rolled wire rod on a conveyor in a state such that said wire rod is in the form of a coil of a continuous series of loops, said wire rod being cooled during said transporting, said conveyor being an elongated member having a center line, said wire being conveyed substantially always at a slant relative to said center line of said conveyor;

changing directions of slant movements of said wire rod alternately to the left and to right relative to said center line of said conveyer at an interval of d/3 to 2 d of a diameter "d" of a ring of said wire rod while the wire rod is advancing in a forward direction at a slant relative to said center line; and shifting the center of said ring of said wire rod from said center line of the conveyer by a length of 2 d/100 to 30 d/100 at its maximum.

2. The method of claim 1, wherein said shifting the center of the ring of the wire rod includes shifting the center of the ring of the wire rod from the center line of the conveyer by a length of 2 d/100 or more to less than 8 d/100 of a diameter of the ring of the wire rod.

3. The method of claim 1, wherein said shifting the center of the ring of the wire rod includes shifting the center of the ring of the wire rod from the center line of the conveyer by a length of 8 d/100 or more to less than 24 d/100 of the diameter of the ring of the wire rod.

4. The method of claim 1, wherein said shifting the center of the ring of the wire rod includes shifting the center of the ring of the wire rod from the center line of the conveyer by a length of more than 24 d/100 to 30 d/100 or less of the diameter of the ring of the wire rod.

* * * * *

UNITED STATES PATENT AND TRADEMARK OFFICE

CERTIFICATE OF CORRECTION

PATENT NO. : 5,052,124

DATED : October 1, 1991

INVENTOR(S) : SEKINE et al

It is certified that error appears in the above-identified patent and that said Letters Patent is hereby corrected as shown below:

Title page, under Section [56] References Cited, insert the following references:

FOREIGN PATENT DOCUMENTS -

| | | |
|---|---|---|
| 49-58838 | 9/1972 | Japan |
| 49-58839 | 9/1972 | Japan |
| 49-15609 | 2/1974 | Japan |

Column 5, line 24, replace "tor" with --for--.

Column 5, line 44, replace "quide" with --guide--.

Column 5, line 45, replace "quide" with --guide--.

Column 5, line 51, replace "quide" with --guide--.

Column 8, line 25, after "said wire", insert --rod--.

Signed and Sealed this

Twenty-first Day of June, 1994

Attest:

Bruce Lehman

BRUCE LEHMAN

Attesting Officer

Commissioner of Patents and Trademarks